US008066350B2

(12) United States Patent
Yoshida

(10) Patent No.: US 8,066,350 B2
(45) Date of Patent: Nov. 29, 2011

(54) INK-JET RECORDING APPARATUS

(75) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 946 days.

(21) Appl. No.: 12/038,756

(22) Filed: Feb. 27, 2008

(65) Prior Publication Data

US 2008/0204496 A1 Aug. 28, 2008

(30) Foreign Application Priority Data

Feb. 28, 2007 (JP) ..... 2007-050335

(51) Int. Cl.
*B41J 2/165* (2006.01)

(52) U.S. Cl. ..... 347/22; 347/20; 347/35; 347/86

(58) Field of Classification Search ..... None
See application file for complete search history.

(56) References Cited

U.S. PATENT DOCUMENTS

| | | | | |
|---|---|---|---|---|
| 6,142,600 | A | 11/2000 | Takahashi et al. | |
| 6,460,962 | B1 | 10/2002 | Dietl et al. | |
| 6,467,869 | B1 * | 10/2002 | Merz et al. | 347/19 |
| 6,502,916 | B1 * | 1/2003 | Naka | 347/14 |
| 6,565,184 | B1 | 5/2003 | Numata et al. | |
| 7,314,263 | B2 | 1/2008 | Hayasaki et al. | |
| 2002/0093555 | A1 | 7/2002 | Kobayashi et al. | |
| 2002/0167555 | A1 | 11/2002 | Miura et al. | |
| 2005/0219309 | A1 | 10/2005 | Uchida | |
| 2007/0126770 | A1 | 6/2007 | Asauchi | |

FOREIGN PATENT DOCUMENTS

| | | | |
|---|---|---|---|
| CN | 1362332 | A | 8/2002 |
| CN | 1672936 | A | 9/2005 |
| EP | 0724966 | A2 | 8/1996 |
| EP | 0960736 | A1 | 12/1999 |

(Continued)

OTHER PUBLICATIONS

Japan Patent Office; Notification of Reason for Refusal in Japanese Patent Application No. 2007-050335 (counterpart to the above-captioned U.S. Patent Application) mailed Jan. 30, 2009.

(Continued)

*Primary Examiner* — Matthew Luu
*Assistant Examiner* — Erica Lin
(74) *Attorney, Agent, or Firm* — Baker Botts L.L.P.

(57) ABSTRACT

An ink-jet recording apparatus including: a cartridge mount; a recording head; an ink passage; an ink discharger; and a controller. An ink cartridge that stores ink is to be replaceably mounted on the cartridge mount. The recording head ejects the ink toward a recording medium. Through the ink passage, the ink is supplied from the cartridge mount to the recording head. The ink discharger discharges the ink. The controller includes a cartridge judgment section and a discharger control section. The cartridge judgment section judges whether the ink cartridge mounted on the cartridge mount is a subject cartridge that satisfies a predetermined condition or not. The discharger control section controls the ink discharger to discharge at least the ink in the ink passage when the cartridge judgment section has judged that the ink cartridge mounted on the cartridge mount is the subject cartridge.

15 Claims, 8 Drawing Sheets

FOREIGN PATENT DOCUMENTS

| | | | |
|---|---|---|---|
| EP | 0999063 | A2 | 5/2000 |
| EP | 1164022 | A2 | 12/2001 |
| EP | 1482723 | A2 | 12/2004 |
| JP | 9156118 | A | 6/1997 |
| JP | 2004-074590 | A | 3/2004 |
| JP | 2005-193522 | A | 7/2005 |
| JP | 2005-288845 | A | 10/2005 |
| JP | 2006-192732 | A | 7/2006 |
| JP | 2007-003833 | A | 1/2007 |
| JP | 2007-118339 | A | 5/2007 |
| WO | 2006025575 | A1 | 3/2006 |

OTHER PUBLICATIONS

European Patent Office; European Search Report in European Patent Application No. 08250620, (counterpart to the above-captioned patent application) mailed Apr. 1, 2009.

The State Intellectual Property Office of the People's Republic of China; Notification of First Office Action in Chinese Patent Application No. 200810081385.3 (counterpart to the above-captioned US patent application) mailed Jul. 10, 2009.

* cited by examiner

INK-JET RECORDING APPARATUS

CROSS REFERENCE TO RELATED APPLICATION

The present application claims priority from Japanese Patent Application No. 2007-050335, which was filed on Feb. 28, 2007, the disclosure of which is herein incorporated by reference in its entirety.

BACKGROUND OF THE INVENTION

1. Field of the Invention

The present invention relates to an ink-jet recording apparatus.

2. Description of the Related Art

There is conventionally known an ink-jet recording apparatus in which ink supplied from its supply source such as an ink cartridge is ejected on a recording sheet on the basis of image data so as to record an image. In such an ink-jet recording apparatus, the ink is supplied in a state in which the ink cartridge is mounted on a cartridge mount. When the ink-jet recording apparatus performs a recording operation, a genuine ink cartridge storing predetermined genuine ink is basically used.

In this respect, in order to prevent clogging in nozzles and a malfunction of the apparatus, Patent Document 1 (Japanese Patent Application Publication No. 9-156118) discloses a technology of forbidding the recording operation where a non-genuine ink cartridge which stores non-genuine ink is mounted on the apparatus.

SUMMARY OF THE INVENTION

However, the non-genuine ink cartridge is widely available today. Thus, where the apparatus using the technology in Patent Document 1 is used, it often happens that the recording operation of the apparatus is forbidden. That is, when a user operates the apparatus to perform the recording operation, the recording operation is not performed. This may cause a risk of dissatisfaction of the user with respect to the apparatus.

Further, where the genuine ink cartridge is replaced with the non-genuine ink cartridge, genuine ink and non-genuine ink are mixed with each other. In this case, a mixture of the inks may be coagulated, thereby causing the risk of a generation of the clogging in nozzles.

Such a coagulation to be generated in the mixture of the inks may also be generated when an ink cartridge is replaced with another ink cartridge whose type is different from that of the replaced ink cartridge, even though both of the ink cartridges store one of the genuine ink and the non-genuine ink.

The present invention has been developed in view of the above-described situations, and it is an object of the present invention to provide an ink-jet recording apparatus configured to perform a recording operation desired by a user and prevent the coagulation and the like when an ink cartridge is newly mounted.

The object indicated above may be achieved according to the present invention which provides an ink-jet recording apparatus, including: a cartridge mount on which an ink cartridge that stores ink is to be replaceably mounted; a recording head which ejects the ink toward a recording medium; an ink passage through which the ink is supplied from the cartridge mount to the recording head; an ink discharger which discharges the ink; and a controller including (a) a cartridge judgment section which judges whether the ink cartridge mounted on the cartridge mount is a subject cartridge that satisfies a predetermined condition or not and (b) a discharger control section which controls the ink discharger to discharge at least the ink in the ink passage when the cartridge judgment section has judged that the ink cartridge mounted on the cartridge mount is the subject cartridge.

In the image recording apparatus constructed as described above, the ink in the ink passage can be replaced with the ink supplied from the ink cartridge mounted on the cartridge mount when a coagulation to be generated in a mixture of the inks is likely to occur. As a result, the ink in the ink passage which has a risk of causing the coagulation is discharged by the ink discharger, thereby reducing the risk of causing the coagulation to be generated in the mixture of inks having different types from each other.

BRIEF DESCRIPTION OF THE DRAWINGS

The above and other objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Figure 1:
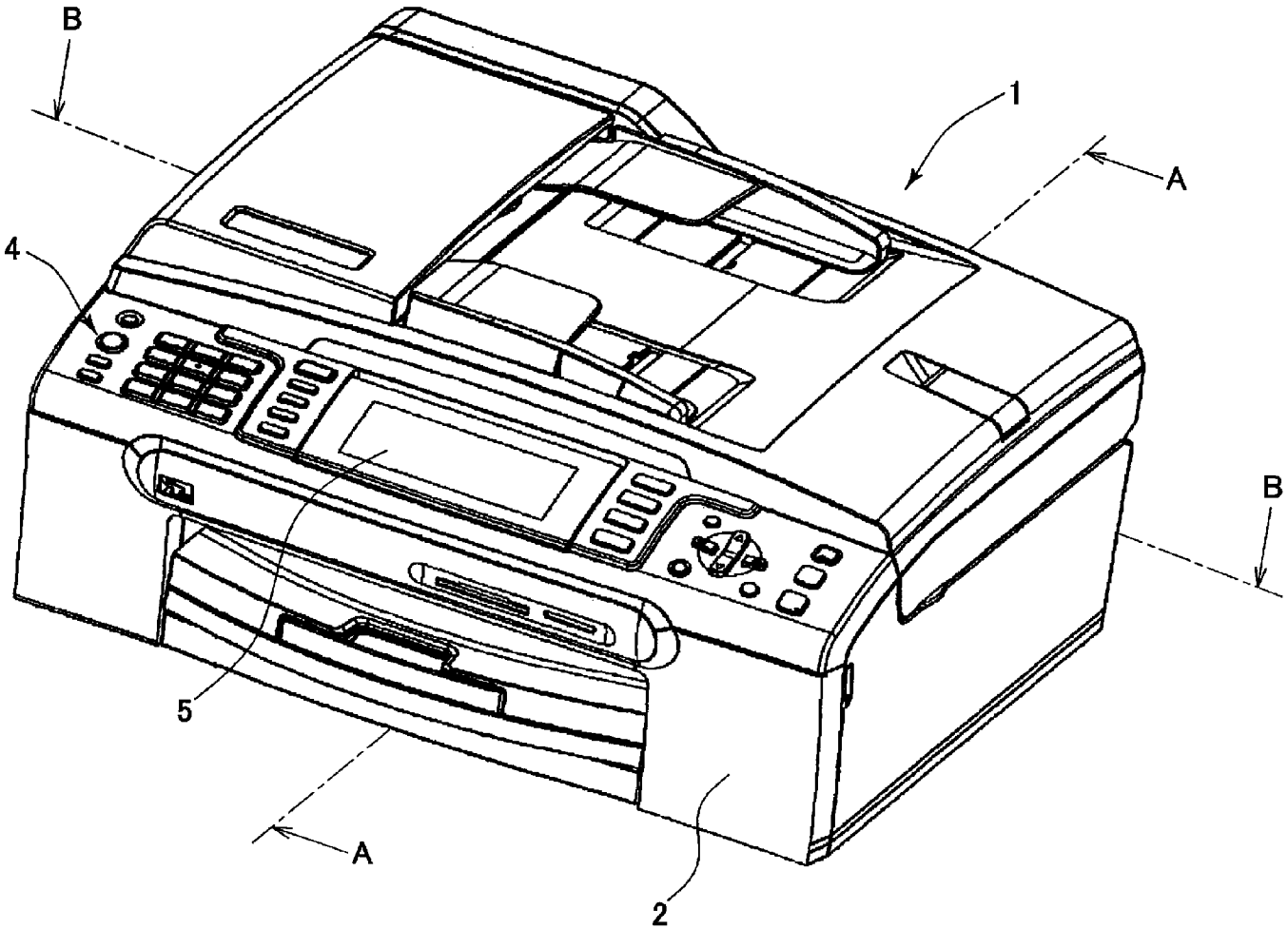
FIG. 1 is an external perspective view of an ink-jet recording apparatus as an embodiment of the present invention.
Figure 5:
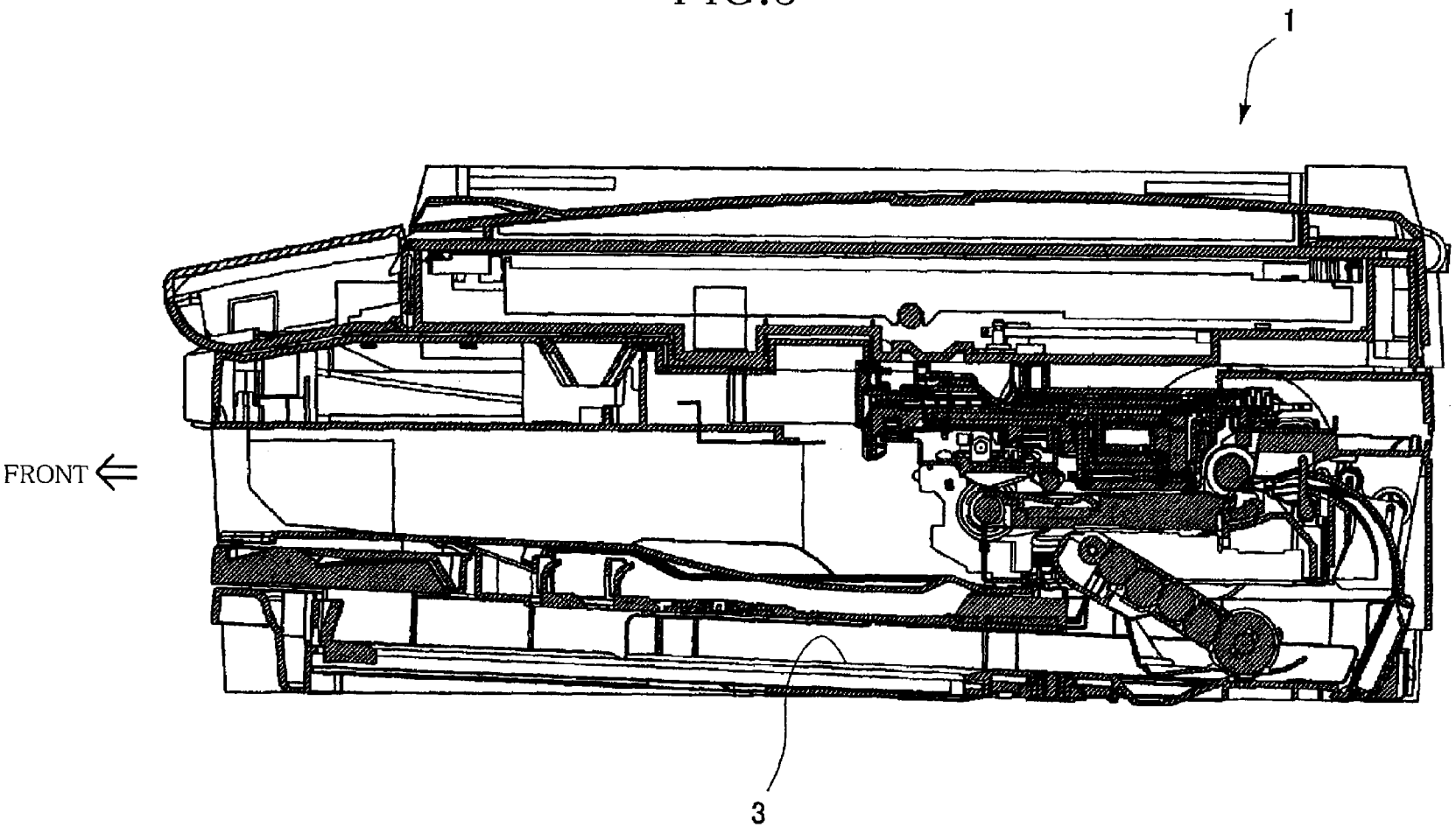
FIG. 5 is a cross-sectional view taken along line A-A in FIG. 1 as seen from a right side of the ink-jet recording apparatus.

Hereinafter, there will be described preferred embodiments of the present invention by reference to the drawings. It is to be understood that the following embodiments are described only by way of example, and the invention may be otherwise embodied with various modifications without departing from the scope and spirit of the invention. FIG. 1 is an external perspective view of an ink-jet recording apparatus 1. Ink cartridges 11 (shown in FIG. 7) storing respective inks 14 (shown in FIG. 7) are replaceably mounted on a cartridge mount 2. In FIG. 1, the cartridge mount 2 is covered with a cover, but the ink cartridges 11 are mounted on the cartridge mount 2 with the cover opened. Various operations of a user such as a replacement of any of the ink cartridges 11 are performed using an operation panel 4. Various messages relating to a recording operation of the ink-jet recording apparatus 1 are displayed on an information display device 5. A cross-sectional view taken along line A-A in FIG. 1 as seen from a right side of the ink-jet recording apparatus 1 is shown in FIG. 5. On the other hand, a cross-sectional view taken along line B-B as seen from an upper side of the ink-jet recording apparatus 1 is shown in FIG. 6.

Figure 2:
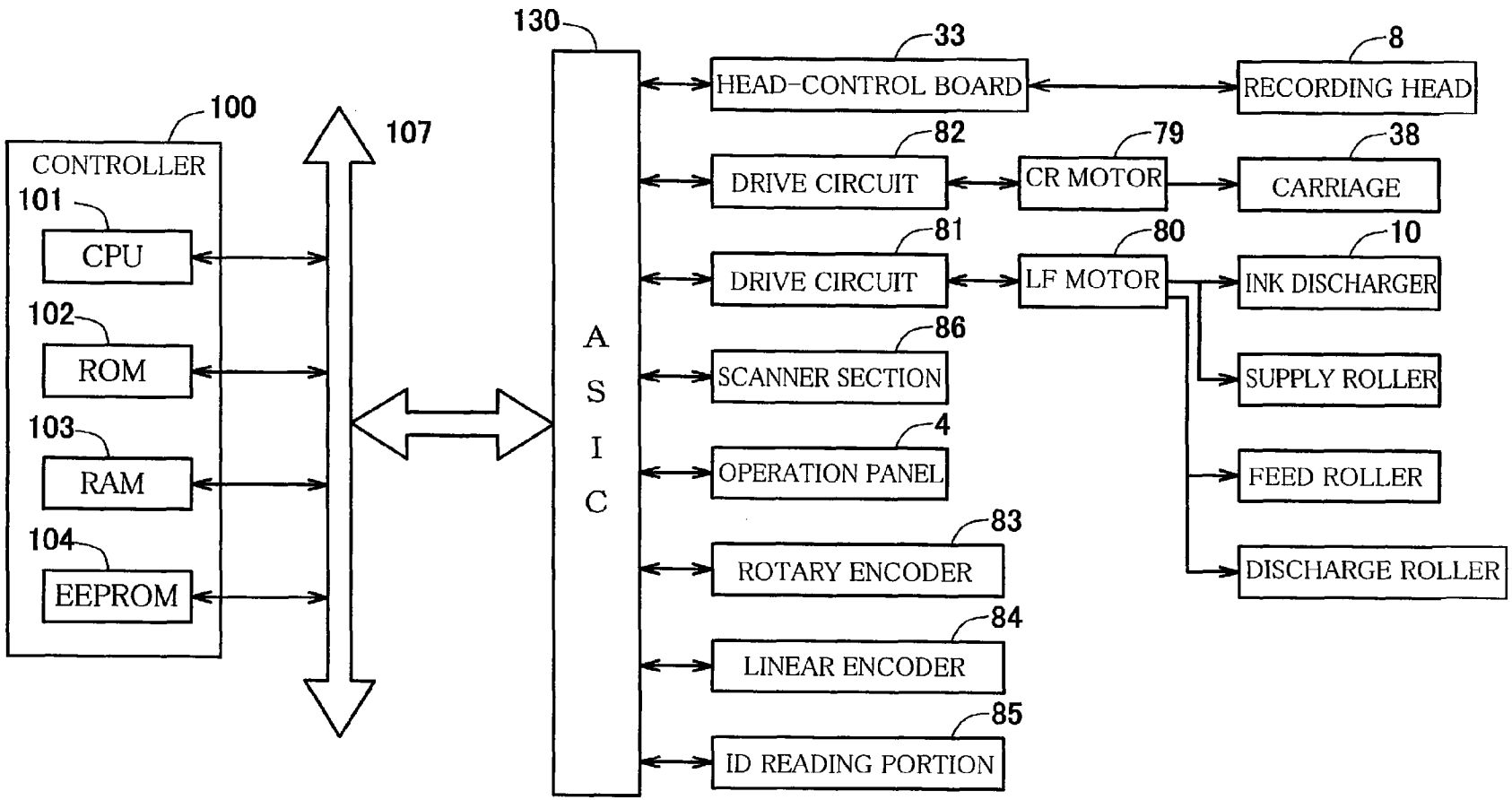
FIG. 2 is a block diagram showing a control system of the ink-jet recording apparatus.

FIG. 2 is a block diagram showing a control system of the ink-jet recording apparatus 1. A controller 100 controls an entirety of the ink-jet recording apparatus 1 and includes a CPU 101 which mainly controls processings of the ink-jet recording apparatus 1, a ROM 102 in which programs for performing operations of the ink-jet recording apparatus 1 are stored, a RAM 103 in which data or programs are developed, and an EEPROM 104 that is a nonvolatile memory. Commands are transmitted from the controller 100 to an ASIC 130 via a bus 107. The ASIC 130 converts the commands into forms respectively suitable for circuits or boards such as a head-control board 33 for controlling recording heads 8, drive circuits 81, 82 for driving a motor and the like, a scanner section 86, the operation panel 4 through which the user operates the ink-jet recording apparatus 1, a rotary encoder 83 used to measure a rotation angle of a roller and the like, a linear encoder 84 for accurately moving a carriage 38, and an ID reading portion 85 for reading an ID of an IC chip mounted on each of the ink cartridges 11. Then, the converted commands are transmitted to the circuits or the boards. Signals transmitted via the drive circuit 82 are transmitted to the carriage 38 via a CR motor 79 for driving the carriage 38 and then operate the carriage 38. On the other hand, signals transmitted via the drive circuit 81 are respectively transmitted to an ink discharger 10 and the like via a LF motor 80 for driving a supply roller and the like and then operate them. Each of signals transmitted from the circuits or the boards such as the head-control board 33, the drive circuits 81, 82, the scanner section 86, the operation panel 4, the rotary encoder 83, the linear encoder 84, and the ID reading portion 85 is converted by the ASIC 130 into a signal having a timing suitable for the bus 107 and transmitted to the controller 100.

FIG. 5 is a cross-sectional view taken along line A-A in FIG. 1 as seen from the right side of the ink-jet recording apparatus 1. A recording sheet is supplied from a sheet supply cassette 3. Then, an image is recorded on the supplied recording sheet, that is, a recording operation is performed.

Figure 6:
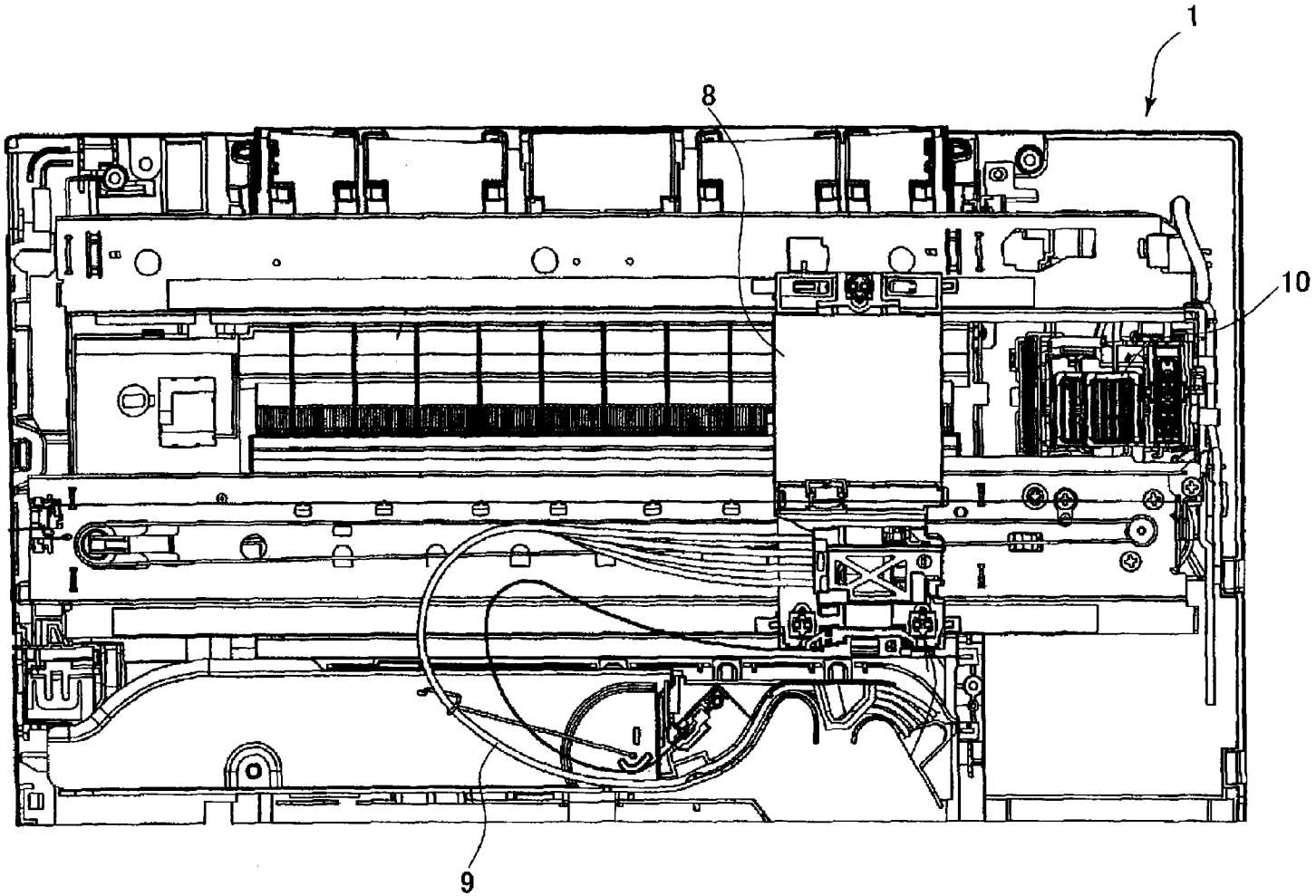
FIG. 6 is a cross-sectional view taken along line B-B in FIG. 1 as seen from an upper side of the ink-jet recording apparatus.

FIG. 6 is a cross-sectional view taken along line B-B in FIG. 1 as seen from the upper side of the ink-jet recording apparatus 1. Each of the inks 14 from a corresponding one of the ink cartridges 11 is supplied through a corresponding one of ink passages which includes a corresponding one of ink passages of the cartridge mount 2, a corresponding one of ink passages of the recording heads 8, and a corresponding one of ink tubes 9 and ejected from the corresponding recording head 8, so that the recording operation is performed. The recording heads 8 are mounted on the carriage 38. More specifically, where the replacement of any of the ink cartridges 11 is recognized, the recording heads 8 are moved by the carriage 38 to the ink discharger 10. Then, a purging operation described below is performed.

Figure 7:
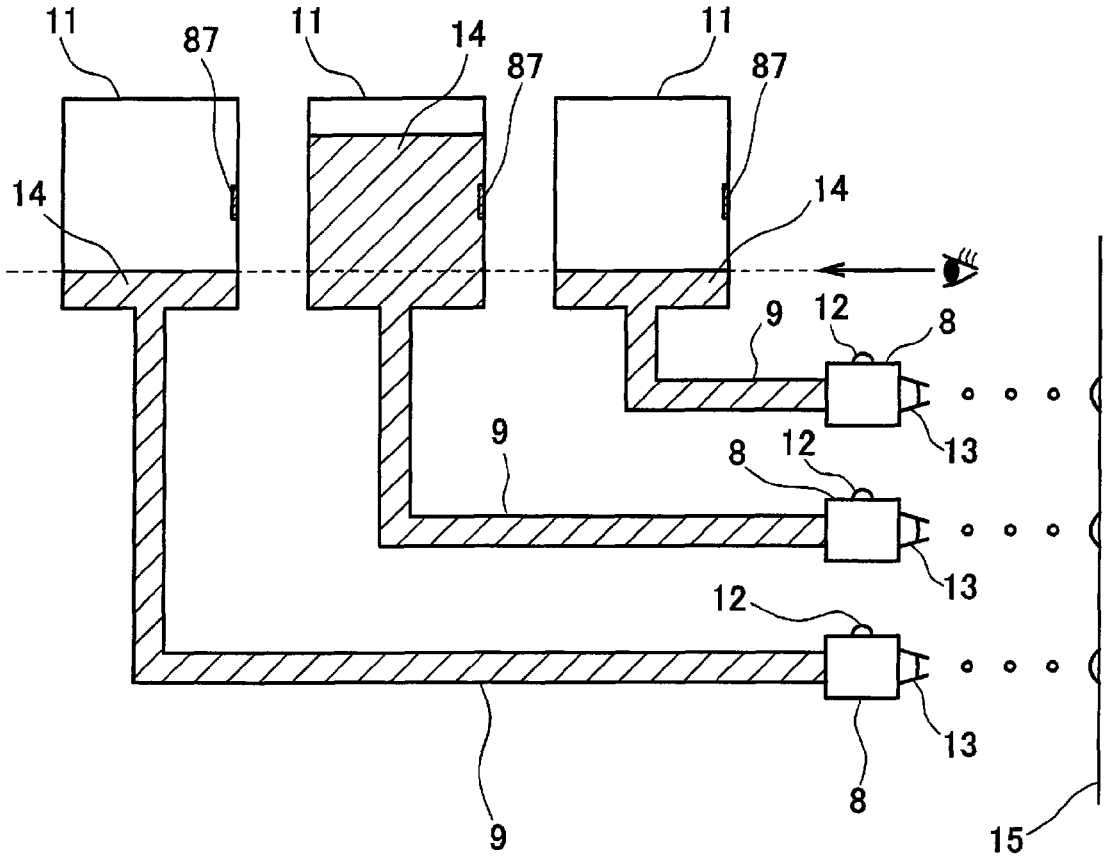
FIG. 7 is a schematic view showing ink passages respectively extending from the ink cartridges to recording heads.

FIG. 7 is an example of ink passages respectively extending from the ink cartridges 11 to the recording heads 8. In the recording operation, each ink 14 from the corresponding ink cartridge 11 is supplied to the corresponding recording head 8 via the corresponding ink tube 9, and is ejected through corresponding nozzles 13 by a corresponding one of piezoelectric elements 12. The ejected inks 14 are sprayed over a recording medium 15 in the form of, e.g., a paper sheet, whereby the recording operation is performed.

Hereinafter, there will be explained the purging operation (hereinafter, may be referred to as a "normal purging operation") performed in the ink-jet recording apparatus 1. It is noted that the explanation below will be described for one of the ink cartridges 11 for the purpose of simplification.

In the vicinity of openings of the nozzles 13, the ink 14 directly contacts ambient air. Thus, a solvent of the ink 14 volatilizes, so that dye components or pigments of the ink 14 are accumulated in the nozzles 13. This causes a risk of clogging in the nozzles 13. To prevent the clogging, the purging operation needs to be regularly performed.

The ink discharger 10 for discharging the ink by performing the purging operation includes a purging device which sucks and discharges the ink from the recording head 8, and an absorbing member which receives the ink discharged by the purging device. More specifically, the purging device sucks the ink from the nozzles 13. Then, the ink sucked by the purging device is absorbed in the absorbing member. As a result, a negative pressure is produced in the ink passage including the ink passage of the recording head 8 and the ink tube 9, so that new ink is supplied from the ink cartridge 11. The absorbing member is replaceable, so that even where the purging device sucks a large amount of the ink, the ink jet recording apparatus 1 can cope with the large amount of ink. The absorbing member is frequently formed of a felt under present circumstances. In addition, the absorbing member formed of cellulose has been proposed. The purging operation is also performed in the replacement of the ink cartridge 11.

Figure 3:
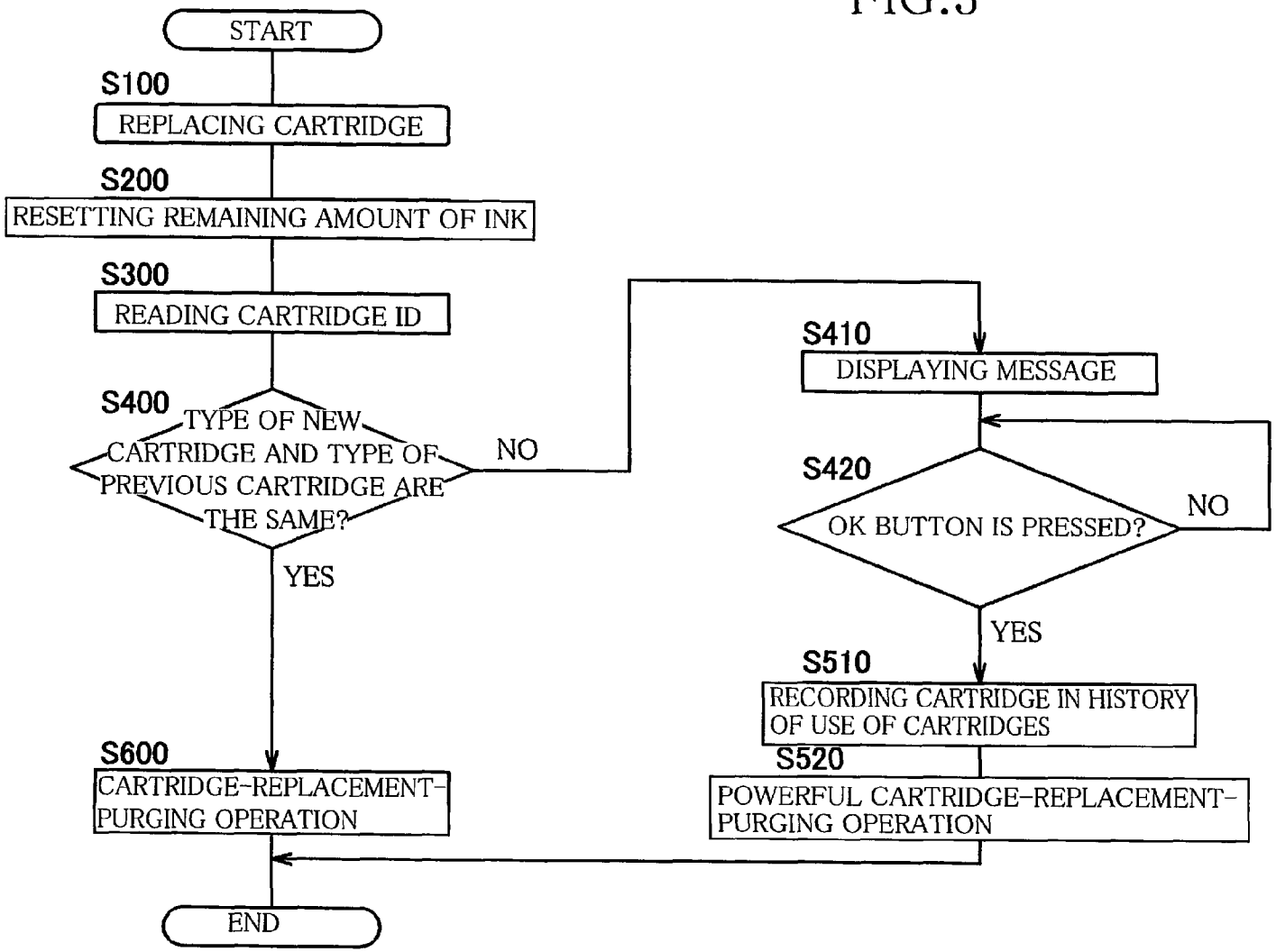
FIG. 3 is a flow chart indicating a flow of a processing performed in a replacement of any of ink cartridges.

Hereinafter, there will be explained a processing performed in the replacement of any of the ink cartridges in the present invention. A flow of the processing is indicated in FIG. 3. It is noted that the explanation below will also be described for one of the ink cartridges for the purpose of simplification.

In S100, when the ink-jet recording apparatus 1 recognizes a start of the replacement of the ink cartridge by, for example, detecting that the cover of the cartridge mount 2 has been opened or detecting that the ink cartridge has been removed, the flow goes to S200 in which to reset a remaining amount of the ink. When the remaining amount of the ink has been reset in S200, the flow goes to S300.

In S300, in order to identify whether a type of a new ink cartridge which is newly mounted on the cartridge mount 2 and a type of a previous ink cartridge which is mounted immediately before the new ink cartridge are different from each other or not, the controller 100 outputs, to the ID reading portion 85, a command for reading an electronic information (e.g., an ID) of the new ink cartridge. When receiving the command outputted from the controller 100, the ID reading portion 85 reads, from an electronic-information storing chip 87 mounted on the new ink cartridge, the electronic information stored in the same 87. When the ID reading portion 85 has read the electronic information, the flow goes to S400.

In S400, whether the electronic information read from the new ink cartridge is an electronic information (e.g., an ID) unique to a manufacturer of the ink-jet recording apparatus 1 or not is judged. Where the read electronic information coincides with the electronic information which is unique to a model of the ink-jet recording apparatus 1 and which is registered by the manufacturer, the controller 100 identifies that the type of the new ink cartridge and the type of the previous ink cartridge are the same as each other. Then, the flow goes to S600.

In S600, a cartridge-replacement-purging operation is performed. In the cartridge-replacement-purging operation, the normal purging operation is performed, and the replacement of the ink cartridge is completed, that is, the processing is completed.

Where the electronic information cannot be read in S300 or where, in S400, the controller 100 recognizes, on the basis of the electronic information read in S300, that the new ink cartridge is for a recording apparatus manufactured by a manufacturer different from that of the ink-jet recording apparatus 1 or is for another model of the recording apparatus 1 manufactured by the manufacturer of the same 1, the controller 100 identifies, in S400, that the type of the new ink cartridge and the type of the previous ink cartridge are different from each other. Then, the flow goes to S410.

In view of the above, in S400, the controller 100 is considered to judge whether the new ink cartridge is a subject cartridge that satisfies a predetermined condition or not. More specifically, the new ink cartridge is judged to the subject cartridge where the new ink cartridge is recognized to have a high possibility of storing ink which adversely affects the recording operation of the ink-jet recording apparatus 1.

Before describing S410, a powerful cartridge-replacement-purging operation in the present invention will be explained.

In the replacement of the ink cartridge, ink remaining in the ink passage contacts ink in an ink supply portion of a new ink cartridge. The inks contacting each other start to diffuse into each other. Where characteristics of respective inks in the new ink cartridge and a replaced previous ink cartridge are different from each other, the inks having the different characteristics are mixedly contained in the ink passage owing to the diffusion, thereby causing a risk of coagulation to be generated in the mixture of the inks in the ink passage. Further, the inks having the different characteristics have the risk of the coagulation in the new ink cartridge in some cases. Thus, at least the ink in the ink passage needs to be discharged. To meet this need, where the controller 100 identifies that the type of the new ink cartridge and the type of the previous ink cartridge are different from each other, that is, the controller 100 judges that the new ink cartridge is the subject cartridge, the powerful cartridge-replacement-purging operation is performed. The powerful cartridge-replacement-purging operation is an operation in which the ink remaining in the ink passage is completely replaced with the ink in the new ink cartridge to prevent the coagulation to be generated in the mixture of the inks having the different characteristics. That is, in the powerful cartridge-replacement-purging operation, the controller 100 controls the ink discharger 10 to discharge at least a part of the ink in the new ink cartridge in addition to the ink in the ink passage when the controller 100 has judged that the new ink cartridge is the subject cartridge.

In the powerful cartridge-replacement-purging operation, a large amount of the ink is discharged when compared with the normal purging operation. That is, the ink discharger 10 discharges a larger amount of the ink when the controller 100 has judged that the new ink cartridge mounted on the cartridge mount 2 is the subject cartridge than when the controller 100 has judged that the new ink cartridge mounted on the cartridge mount 2 is not the subject cartridge. More specifically, the amount of the ink discharged in the powerful cartridge-replacement-purging operation is from one to five times larger than a capacity of the ink passage or is the total amount of the capacity of the ink passage and volume ranging from 0 to 10 ml. That is, at least a part of the ink in the ink cartridge is discharged in some cases.

The capacity of the ink passage is about 2 ml while a capacity of the ink cartridge is about 9 ml. Thus, where the large amount of the ink is required in the powerful cartridge-replacement-purging operation, a plurality of ink cartridges may be required.

Figure 8:
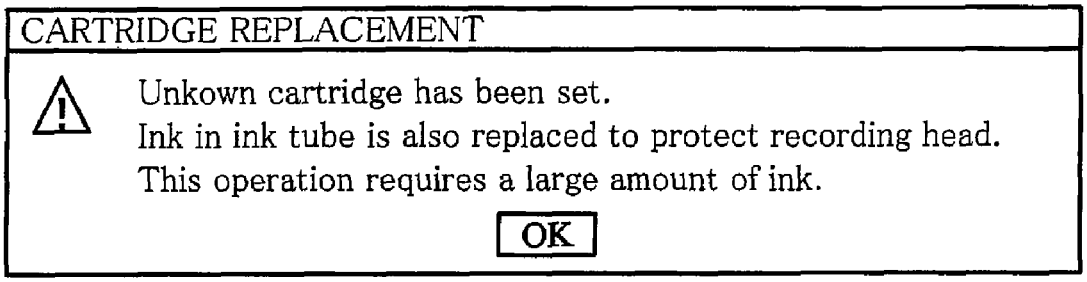
FIG. 8 is an example of a warning message displayed when any of the ink cartridges is replaced with the non-genuine one.

When performing the powerful cartridge-replacement-purging operation, a warning message relating to the powerful cartridge-replacement-purging operation is displayed in S410. The warning message shows a risk of consumption of the large amount of the ink, for example. That is, the controller 100 performs a processing for informing, through the information display device 5, a fact that the subject cartridge is being mounted, when the controller 100 has judged that the new ink cartridge is the subject cartridge. Where a user agrees to a performance of the powerful cartridge-replacement-purging operation after confirming the warning message, the user indicates an intention of the agreement. For example, as the indication of the intention of the agreement, the user presses an OK button or a button corresponding to the OK button provided on the operation panel 4. The controller 100 judges, in S420, whether the user indicates the intention of the agreement or not. The display of the warning message permits the user to understand risks in the powerful cartridge-replacement-purging operation. FIG. 8 shows an example of the warning message.

Where the plurality of the ink cartridges are required in the powerful cartridge-replacement-purging operation, a required number of the ink cartridges may be displayed on the information display device 5 in displaying the warning message, thereby permitting a user to grasp the required number of the ink cartridges. This prevents a shortage of the ink cartridges in the powerful cartridge-replacement-purging operation. Further, the ink-jet recording apparatus 1 may be configured such that, where the ink in a new ink cartridge is used up in the powerful cartridge-replacement-purging operation, the ink cartridge is replaced after the powerful cartridge-replacement-purging operation is canceled. Alternatively, the ink-jet recording apparatus 1 may be configured such that, where the ink in the new ink cartridge is used up in the powerful cartridge-replacement-purging operation, the ink cartridge is replaced in a state in which the powerful cartridge-replacement-purging operation pauses, whereby the powerful cartridge-replacement-purging operation can be restarted after the replacement of the ink cartridge.

The EEPROM 104 stores a history of the use of ink cartridges each of which has a type different from that of an ink cartridge mounted immediately before each ink cartridge. That is, the EEPROM 104 stores information with respect to whether the new ink cartridge mounted on the cartridge mount 2 is the subject cartridge that satisfies the predetermined condition or not. Where the controller 100 judges, in S420, that the user indicates the intention of the agreement by, e.g., the press of the OK button, the use of the new ink cartridge whose type is different from that of the previous cartridge is recorded, in S510, in the history stored in the EEPROM 104. Thus, where the ink-jet recording apparatus 1 fails due to the coagulation, the user can judge, using the history, whether the failure is caused because the previous ink cartridge is replaced with the new ink cartridge whose type is different from that of the previous ink cartridge or not. After the recording of the new ink cartridge, the flow goes to S520. In S520, the powerful cartridge-replacement-purging operation is performed, and the processing shown in FIG. 3 is completed.

Figure 4:
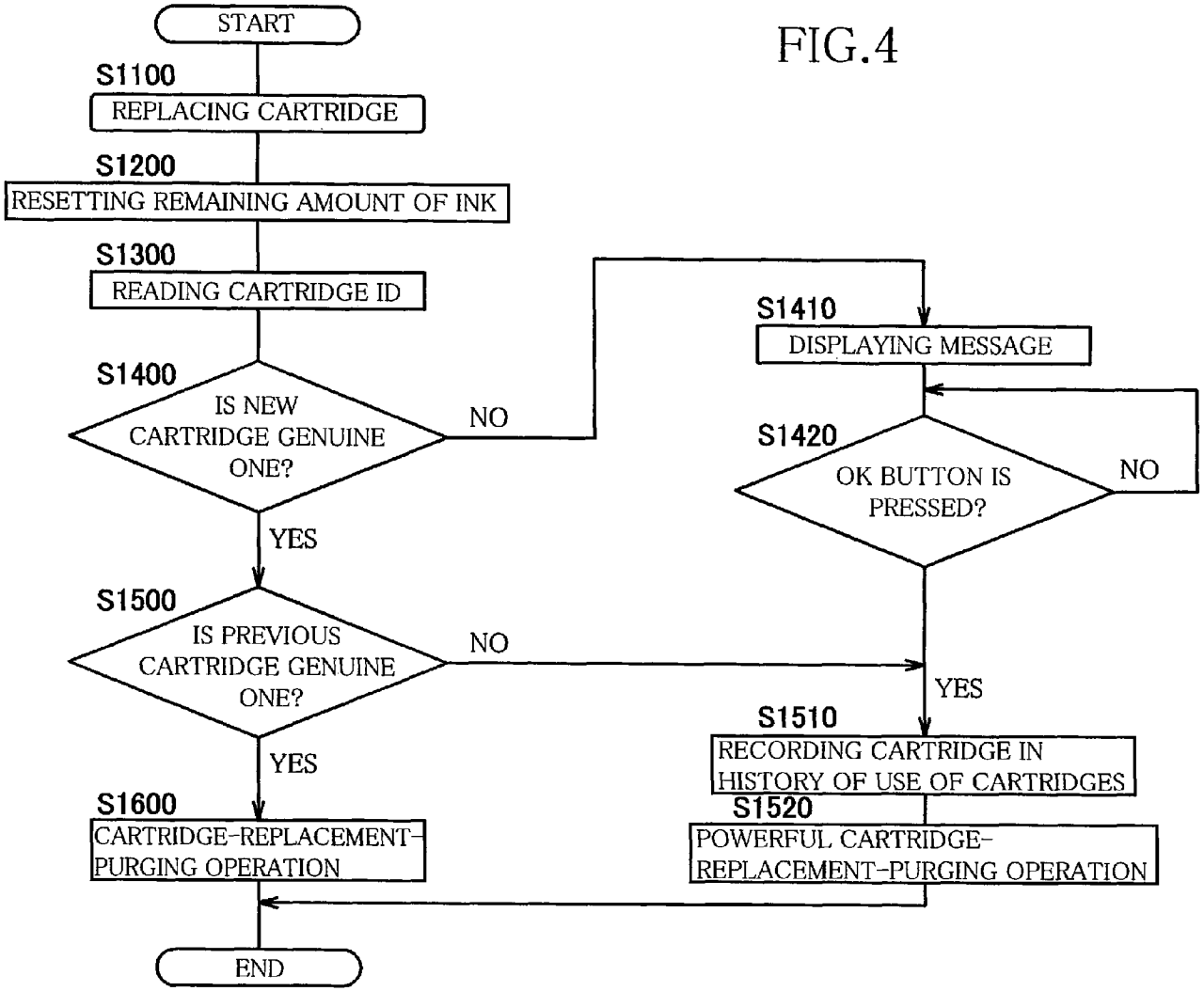
FIG. 4 is a flow chart indicating a flow of a processing performed in a replacement of any of the ink cartridges in a case where the ink cartridges are classified into genuine one and non-genuine one.

FIG. 4 is a flow chart indicating a flow of a processing performed in the replacement of any of the ink cartridges in a case where the ink cartridges are classified into genuine one and non-genuine one. In this processing, whether a type of a new ink cartridge and a type of a previous ink cartridge are different from each other or not is judged on the basis that each of the ink cartridges is the genuine one or the non-genuine one. More specifically, the controller 100 judges that the new ink cartridge mounted on the cartridge mount 2 is the subject cartridge where the new ink cartridge mounted on the cartridge mount 2 is non-genuine one. In other words, the controller 100 judges that the new ink cartridge mounted on the cartridge mount 2 is the subject cartridge on the condition that the previous ink cartridge is replaced with the new ink cartridge whose type is different from that of the previous ink cartridge. In this judgment, whether the type of the new ink cartridge and the type of the previous ink cartridge are different from each other or not is judged on the basis that each of the ink cartridges is the genuine one or the non-genuine one. The flow of the processing will be explained below. It is noted that the explanation below will also be described for one of the ink cartridges for the purpose of simplification.

Initially, in S1100, when the ink-jet recording apparatus 1 recognizes a start of the replacement of the ink cartridge, the flow goes to S1200 in which to reset a remaining amount of the ink. When the remaining amount of the ink has been reset in S1200, the flow goes to S1300.

In S1300, in order to identify that a new ink cartridge is the genuine one or the non-genuine one, the controller 100 outputs, to the ID reading portion 85, a command for reading an electronic information (e.g., an ID) of the new ink cartridge. When receiving the command outputted from the controller 100, the ID reading portion 85 reads, from the electronic-information storing chip 87 provided for or mounted on the new ink cartridge, the electronic information stored in the same 87. When the ID reading portion 85 has read the electronic information, the flow goes to S1400.

In S1400, the electronic information read by the ID reading portion 85 is transmitted to the controller 100. Then, the controller 100 identifies the new ink cartridge is the genuine one or the non-genuine one by judging whether the electronic information read from the new ink cartridge is the electronic information (e.g., the ID) unique to the manufacturer of the ink-jet recording apparatus 1 or not. That is, whether the new ink cartridge is the subject cartridge that satisfies the predetermined condition or not is judged on the basis of the electronic information stored in the electronic-information storing chip 87, thereby leading to higher reliability of the judgment. Where the read electronic information coincides with the electronic information which is unique to the model of the ink-jet recording apparatus 1 and which is registered by the manufacturer, the controller 100 identifies the new ink cartridge is the genuine one. On the other hand, where the electronic information cannot be read in S1300 or where, in S1400, the controller 100 recognizes, on the basis of the electronic information read in S1300, that the new ink cartridge is for a recording apparatus manufactured by a manufacturer different from that of the ink-jet recording apparatus 1 or for another model of the recording apparatus 1 which is manufactured by the manufacturer of the same 1, the controller 100 identifies, in S1400, that the new ink cartridge is the non-genuine one.

Where the controller 100 has identified that the new ink cartridge is the genuine one, the flow goes to the S1500. In S1500, electronic information with respect to the previous ink cartridge is read from the EEPROM 104 which records various electronic information. Then, the controller 100 identifies, on the basis of the read electronic information, that the previous ink cartridge is the genuine one or the non-genuine one.

Where the controller 100 has identified, in S1500, that the previous ink cartridge is the genuine one, the flow goes to S1600. In S1600, the normal purging operation is performed, and the replacement of the ink cartridge is completed, that is, the processing is completed.

Where the controller 100 has identified, in S1400, that the new ink cartridge is the non-genuine one, that is, the controller 100 has identified that the new ink cartridge is the subject cartridge, the above-described powerful cartridge-replacement-purging operation is performed in S1520. In other words, the controller 100 judges that the new ink cartridge is the subject cartridge where the new ink cartridge is recognized to have the high possibility of storing ink which adversely affects the recording operation of the ink-jet recording apparatus 1. More specifically, the controller 100 judges that the new ink cartridge is the subject cartridge where the new ink cartridge is non-genuine one.

When performing the powerful cartridge-replacement-purging operation, the warning message relating to the powerful cartridge-replacement-purging operation is displayed on the information display device 5 in S1410. That is, the controller 100 performs the processing for informing, through the information display device 5, a fact that the subject cartridge is being mounted, when the controller 100 has judged that the new ink cartridge is the subject cartridge. Where a user agrees to the performance of the powerful cartridge-replacement-purging operation after confirming the warning message, the user indicates the intention of the agreement. The controller 100 judges, in S1420, whether the user indicates the intention of the agreement or not. The display of the warning message permits the user to understand the risks in the powerful cartridge-replacement-purging operation. FIG. 8 shows the example of the warning message.

Where the controller 100 has identified, in S1500, that the previous ink cartridge is the non-genuine one, the warning message may be displayed like in S1410. Thus, the user can understand the risks in the powerful cartridge-replacement-purging operation like in S1410.

The EEPROM 104 stores a history of the use of non-genuine ink cartridges. When the intention of the agreement is confirmed by, e.g., the press of the OK button in S1420, the use of the new ink cartridge is recorded, in S1510, in the history stored in the EEPROM 104. After this recording, the flow goes to S1520. In S1520, the powerful cartridge-replacement-purging operation is performed, and the processing shown in FIG. 4 is completed.

In view of S510 and S1510, the EEPROM 104 may be referred to as a cartridge-information storing section storing information with respect to whether the new ink cartridge is the subject cartridge or not. Further, in view of the above, the controller 100 can be considered to include a discharger control section which controls the ink discharger 10 to discharge at least the ink in the ink passage when the controller 100 has judged that the ink cartridge mounted on the cartridge mount 2 is the subject cartridge, and which is constituted by a portion of the controller 100 for executing S520 and S1520. This configuration can reduce the coagulation to be generated in the mixture of the inks in the new ink cartridge.

Further, in view of the above, the controller 100 can be considered to include a cartridge judgment section which judges whether an ink cartridge mounted on the cartridge mount 2 is the subject cartridge that satisfies the predetermined condition or not, and which is constituted by a portion of the controller 100 for executing S400, S1400, and S1500. Furthermore, the controller 100 can be considered to include an informing section which performs a processing for informing, through the information display device 5, a fact that the subject cartridge is being mounted, when the cartridge judgment section has judged that the new ink cartridge is the subject cartridge, and which is partly constituted by a portion for executing S410, and S1410.

Displaying equipments for warning such as an LED may be provided on the ink-jet recording apparatus 1 instead of the warning message, and may be controlled to blink and/or simply light up when the powerful cartridge-replacement-purging operation needs to be performed. This configuration permits an ink-jet recording apparatus not including a relatively large display device (e.g., a liquid crystal display) to employ the configuration of the ink-jet recording apparatus of the present invention.

The warning message is displayed on the information display device 5 in the above-described embodiment, but the ink-jet recording apparatus 1 may be configured to be connectable to an external terminal (e.g., a PC) such that the informing section performs the processing for informing the fact that the subject cartridge is being mounted (i.e., the warning message) through the external terminal. More specifically, the ink-jet recording apparatus 1 may be configured such that, in above-described S420 and S1420, the user can click on an OK image or an image corresponding to the OK image displayed on the external terminal connected to the ink-jet recording apparatus 1 instead of pressing the OK button or the button corresponding to the OK button provided on the operation panel 4. As a result, the user can understand the fact that the subject cartridge is being mounted at a position far from the ink-jet recording apparatus 1. In addition, the operation panel 4 can be smaller in size, leading to a size reduction of the ink-jet recording apparatus 1. In this case, the user can confirm whether the powerful cartridge-replacement-purging operation is to be performed or not by operating the information display device 5 or the external terminal.

Further, as a modification of the above-described method, the ink-jet recording apparatus 1 may be configured to be connectable to a communication network such as an internet. As a result, where the non-genuine ink cartridge is used, the history of the use of the non-genuine ink cartridges may be transmitted to a support center of the manufacturer via the communication network. The support center can use the history. In view of this modification, the controller 100 can be considered to include a cartridge-information sending section which sends, via the communication network, information with respect to whether the new ink cartridge is the subject cartridge or not, and which is constituted by a portion of the controller 100 for executing S510, and S1510.

What is claimed is:

1. An ink-jet recording apparatus, comprising:

a cartridge mount on which an ink cartridge that stores ink is to be replaceably mounted;

a recording head which ejects the ink toward a recording medium;

an ink passage through which the ink is supplied from the cartridge mount to the recording head;

an ink discharger which discharges the ink from the recording head; and a controller including (a) a cartridge judgment section which judges whether the ink cartridge mounted on the cartridge mount is a subject cartridge that satisfies a predetermined condition or not and (b) a discharger control section which controls the ink discharger to discharge at least the ink in the ink passage when the cartridge judgment section has judged that the ink cartridge mounted on the cartridge mount is the subject cartridge, wherein the discharger control section is configured to control the ink discharger to discharge, from the recording head, at least a part of the ink in the ink cartridge currently mounted on the cartridge mount in addition to all the ink in the ink passage when the cartridge judgment section has judged that the ink cartridge mounted on the cartridge mount is the subject cartridge, and wherein the ink discharger discharges a larger amount of the ink when the cartridge judgment section has judged that the ink cartridge mounted on the cartridge mount is the subject cartridge than when the cartridge judgment section has judged that the ink cartridge mounted on the cartridge mount is not the subject cartridge.

2. The ink-jet recording apparatus according to claim 1, wherein the cartridge judgment section is configured to judge that the ink cartridge mounted on the cartridge mount is the subject cartridge, where a type of the ink cartridge mounted on the cartridge mount and a type of an ink cartridge mounted immediately before the ink cartridge mounted on the cartridge mount are different from each other.

3. The ink-jet recording apparatus according to claim 2, wherein the cartridge judgment section is configured to identify whether the type of the ink cartridge mounted on the cartridge mount and the type of the ink cartridge mounted immediately before the ink cartridge mounted on the cartridge mount are different from each other or not, on the basis that each of the ink cartridges is a genuine one or a non-genuine one.

4. The ink jet recording apparatus according to claim 1, wherein the cartridge judgment section is configured to judge that the ink cartridge mounted on the cartridge mount is the subject cartridge, where the ink cartridge mounted on the cartridge mount is a non-genuine one.

5. The ink-jet recording apparatus according to claim 1, wherein the cartridge judgment section is configured to judge that the ink cartridge mounted on the cartridge mount is the subject cartridge, where the ink cartridge mounted on the cartridge mount is recognized to have a high possibility of storing ink which adversely affects a recording operation of the ink-jet recording apparatus.

6. The ink-jet recording apparatus according to claim 1, wherein the cartridge judgment section is configured to judge whether the ink cartridge mounted on the cartridge mount is the subject cartridge or not, on the basis of electronic information stored in an electronic-information storing chip provided for the ink cartridge.

7. The ink-jet recording apparatus according to claim 1, wherein the ink discharger includes a purging device which discharges the ink from the recording head.

8. The ink-jet recording apparatus according to claim 1, further comprising a replaceable absorbing member which receives the ink discharged by the ink discharger.

9. The ink-jet recording apparatus according to claim 1, wherein the controller includes a cartridge-information storing section storing information with respect to whether the ink cartridge mounted on the cartridge mount is the subject cartridge or not.

10. The ink-jet recording apparatus according to claim 1, configured to be connectable to a communication network, wherein the controller includes a cartridge-information sending section which sends, via the communication network, information with respect to whether the ink cartridge mounted on the cartridge mount is the subject cartridge or not.

11. The ink-jet recording apparatus according to claim 1, wherein the controller includes an informing section which performs a processing for informing a fact that the subject cartridge is being mounted, when the cartridge judgment section has judged that the ink cartridge mounted on the cartridge mount is the subject cartridge.

12. The ink-jet recording apparatus according to claim 11, further comprising an information display device, wherein the informing section is configured to perform the processing for informing the fact through the information display device.

13. The ink-jet recording apparatus according to claim 11, configured to be connectable to an external terminal, wherein the informing section is configured to perform the processing for informing the fact through the external terminal.

14. The ink-jet recording apparatus according to claim 1, wherein the ink passage includes an ink tube, and wherein the discharger control section is configured to control the ink discharger to discharge, from the recording head, at least a part of the ink in the ink cartridge currently mounted on the cartridge mount in addition to all the ink in the ink passage including the ink tube when the cartridge judgment section has judged that the ink cartridge mounted on the cartridge mount is the subject cartridge.

15. The ink-jet recording apparatus according to claim 14, wherein the recording head and the ink cartridge are distant from each other, and wherein the ink tube is disposed between the recording head and the ink cartridge.

* * * * *